US005762237A

United States Patent [19]

Chang

[11] Patent Number: 5,762,237

[45] Date of Patent: Jun. 9, 1998

[54] CARTRIDGE LOCK FOR CAULK DISPENSING DEVICES

[76] Inventor: Peter J. Chang, 11001 Petersborough Dr., Rockville, Md. 20852

[21] Appl. No.: 597,263

[22] Filed: Feb. 6, 1996

[51] Int. Cl.[6] ..... B67B 5/32

[52] U.S. Cl. ..... 222/153.09; 222/327

[58] Field of Search ..... 222/326, 327, 222/340, 153.09, 391

[56] References Cited

U.S. PATENT DOCUMENTS

| | | | |
|---|---|---|---|
| 1,986,166 | 1/1935 | Schneider | 222/340 X |
| 3,381,861 | 5/1968 | Stein | 222/327 X |
| 4,204,616 | 5/1980 | Chang | 222/391 |
| 5,336,014 | 8/1994 | Keller | 222/327 X |

*Primary Examiner*—Gregory L. Huson
*Attorney, Agent, or Firm*—Law Offices of Royal W. Craig

[57] ABSTRACT

A simple, inexpensive and efficient cartridge lock to retain a caulk cartridge within the frame of a caulk gun until intentionally released by the operator, thereby eliminating a potential safety hazard. The cartridge lock includes a resilient spacer having a central passage for slidable insertion over the plunger shaft of the caulk gun. The spacer is inserted onto the plunger shaft and is carried thereon between the piston and supporting wall to require an additional measure of force for retraction of the plunger shaft in order to insert a new cartridge or remove an old one. This avoids inadvertent release and fall-through of the cartridge. Various embodiments of the spacer are contemplated including a constricted spring having one end formed with coils sized for slidable insertion over the plunger shaft, and a constricted end formed with at least one tighter coil for gripping the plunger shaft. The constricted spring is inserted onto the plunger shaft and is carried thereon between the piston and supporting wall. Alternatively, the resilient spacer may be a length of resilient material formed in an arc and having a central through-bore for insertion on the plunger shaft.

10 Claims, 5 Drawing Sheets

CARTRIDGE LOCK FOR CAULK DISPENSING DEVICES

FIELD OF THE INVENTION

The present invention relates to dispensing devices and, more particularly, to hand-held caulk guns for ejecting caulk compound from a disposable cartridge.

BACKGROUND OF THE INVENTION

Conventional economy brand caulking guns are generally manual trigger-operated devices incorporating a unidirectional gripping assembly which urges a piston rod forward to eject the compound from a cartridge. One such prior art caulk gun is set forth in FIG. 1. This is a lightweight, skeleton-frame caulking gun designed to receive and carry a disposable caulk cartridge 20. Unfortunately, this skeleton-frame gun presents serious safety problems in loading and unloading the cartridge 20. Loading can be somewhat awkward and, depending on whether the user is left-handed or right-handed, takes place from the left or right. The operator only has two hands; one holds the cartridge and the other holds the caulking gun at the handle. Just a moment's carelessness or distraction of the operator may cause the pointed end or nozzle 20' of the cartridge to miss when thrust at the opening 26'. When the hand holding the cartridge 20 is shifted to line up the rear with the plunger, the cartridge will inadvertently fall through the open frame onto whatever may be below, point down. Typically, the user tilts the gun for better access, thereby increasing the danger of dropping the cartridge through the frame. Even when dropped on the foot a loaded cartridge can produce injury. When dropped from a scaffolding or ladder the lethal potential of the sharp point is evident.

When the cartridge is empty and in need of replacement, the plunger is retracted all the way. Once the piston is removed from within the caulk cartridge, the cartridge 20 becomes free to fall out of the barrel. Again, a serious safety threat is posed during unloading.

U.S. Pat. No. 4,204,616 issued to the inventor named herein for his "Adjustable Safety Guide for Skeleton Type Caulking Gun" is an attempt to solve the above-described problems. This patented gun (shown in FIG. 2) includes a flexible-panel guard 32 (which may be canvas or other lightweight sheeting) secured along the barrel arms of the caulking gun. Enough slack is provided for the guard to fit as a half-sleeve around one side of a standard size cartridge installed in the caulking gun. The cartridge can be installed from either side. The guard automatically alleviates the cartridge drop-through hazard during loading regardless of from which side of the caulking gun the cartridge is inserted. The guard also helps during unloading since the empty cartridge is partially supported after the piston is retracted. However, the guard has a few drawbacks. For instance, it is labor-intensive and relatively expensive to manufacture and install. In addition, compound often spills over onto the guard and it becomes messy and hard to use, especially if it hardens. This can shorten the useful life of the gun.

It would be greatly advantageous to provide a more economical safety lock for retaining a caulk cartridge within the barrel arms during loading until intentionally unlocked by the operator.

SUMMARY OF THE INVENTION

In accordance with the above, it is an object of the present invention to provide a simple, inexpensive and efficient cartridge locking mechanism to retain a caulk cartridge within the frame of a caulk gun until intentionally released by the operator, thereby eliminating a potential safety hazard.

It is a further object to provide a safety lock as described above which is easy to use by either right-handed or left-handed users.

The above and other objects and advantages of the invention will become more readily apparent on examination of the following description, including the drawings, in which like reference numerals refer to like parts. For the purpose of illustration, the cartridge-lock is shown in the context of skeleton-frame caulking gun of the type having a metal or single piece molded plastic open frame secured to a supporting wall and extending forwardly therefrom. A thrust mechanism is supported in a housing behind the supporting wall and is actuated by a downwardly extending trigger to drive a plunger shaft that is slidably supported in the housing. A piston is mounted on the distal end of the plunger shaft and, when advanced through the frame and cartridge, dispenses caulking composition from the cartridge. As will be seen, the cartridge-lock must be used with an open front support for supporting the nozzle of the cartridge. A closed front support would block proper insertion of the cartridge.

The improvement disclosed herein includes a cartridge-lock comprising a resilient spacer having a central passage for slidable insertion over the plunger shaft. The spacer is inserted onto the plunger shaft and is carried thereon between the piston and supporting wall. The resilient spacer is interposed between the piston and supporting wall to require an additional measure of force for retraction of the plunger shaft in order to insert a new cartridge or remove an old one.

In one embodiment, the resilient spacer is a constricted spring having one end formed with coils sized for slidable insertion over the plunger shaft, and a constricted end formed with at least one tighter coil for gripping the plunger shaft. The constricted spring is inserted onto the plunger shaft and is carried thereon between the piston and supporting wall.

In another embodiment, the resilient spacer is a length of resilient material formed in an arc and having a central through-bore for insertion on the plunger shaft.

In these and other embodiments, the resilient spacer is interposed between the piston and supporting wall to require an additional measure of force for full retraction of the plunger shaft in order to insert a new cartridge or remove an old one.

All of the subsequently described cartridge lock assemblies avoid inadvertent release and fall-through of the cartridge. They are simple and inexpensive to manufacture, yet highly effective. Their simplicity allows them to be manufactured OEM or retrofit for minimal additional cost.

BRIEF DESCRIPTION OF DRAWINGS

FIG. 9 is a side elevation view of another embodiment of the cartridge lock similar to that as shown in FIG. 3, except that the constricted spring 100 is attached to supporting wall 33.

FIG. 10 is a side elevation view of another embodiment of the cartridge lock similar to that as shown in FIG. 6, except that the resilient section 200 is attached to supporting wall 33.

DETAILED DESCRIPTION OF THE PREFERRED EMBODIMENTS

Figure 1:
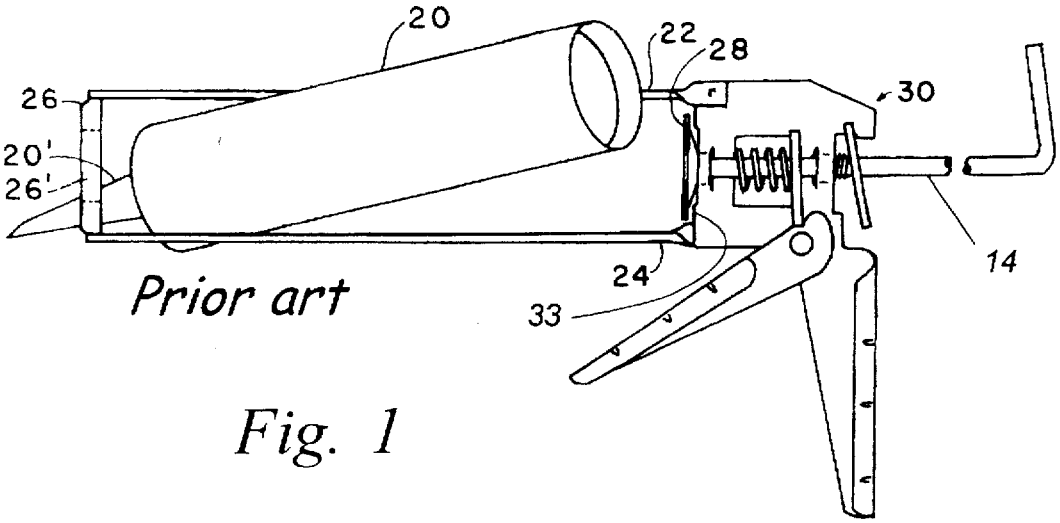
FIG. 1 is a side elevational view of a prior art skeleton-frame gun showing the problem of loading.

FIG. 1 is a side elevational view of a prior art skeleton-frame gun showing the problem of loading. This open-frame skeleton gun incorporates a forward frame with two opposing arms 22 and 24 extending between a supporting wall 33 and a forward support yoke 26. The illustrated frame is adapted for carrying a conventional replaceable caulk cartridge 20 which may be inserted in advance of supporting wall 33 with its nozzle cradled in support yoke 26.

A piston 28 is mounted at the distal end of a plunger shaft 14. A thrust assembly effects forward operation of the plunger shaft 14 and piston 28. The thrust assembly is actuated by a trigger that is retracted by hand to urge a grip forward. As the grip is biased forward it reaches a critical angle where it engages plunger shaft 14, and further retraction of the trigger is converted into lateral movement of plunger drive shaft 14. The plunger drive shaft 14 urges piston 28 incrementally forward through cartridge 20 in order to expel its contents.

When the cartridge is empty and in need of replacement, a rearward release lever is depressed to free the plunger shaft 14, and plunger shaft 14 is retracted. Plunger shaft 14 must be fully retracted to remove the cartridge otherwise the presence of the piston 28 inside the cartridge anchors it within the frame. Once the piston clears the interior confines of the caulk cartridge, the cartridge 20 becomes unconstrained and is free to fall out of the frame. There is no way for the user to gauge when the cartridge 20 will fall free. This presents a serious safety threat during unloading, especially if the gun is being operated on top of a ladder.

Figure 2:
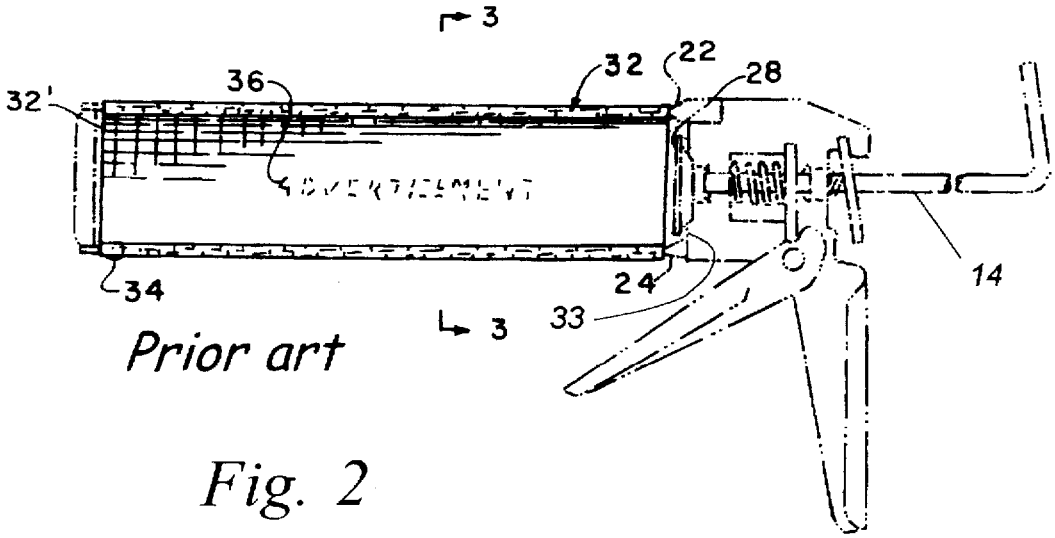
FIG. 2 is a side elevational view of a prior art attempt to solve the above-described loading problem as set forth in U.S. Pat. No. 4,204,616 issued to the inventor named herein for his "Adjustable Safety Guide for Skeleton Type Caulking Gun".

FIG. 2 shows a partial solution as set forth in U.S. Pat. No. 4,204,616 issued to the inventor named herein for his "Adjustable Safety Guide for Skeleton Type Caulking Gun". This gun includes a flexible-panel guard 32 formed of canvas, Mylar, or other lightweight sheeting. The guard 32 is secured along the opposing arms 22, 24 of the frame. Enough slack is provided for the guard to fit as a half-sleeve around one side of a standard size cartridge installed in the gun. Guard 32 prevents cartridge drop-through during loading and helps during unloading since the empty cartridge is at least partially supported after the piston is retracted therefrom. However, guard 32 is labor-intensive and relatively expensive to manufacture and install. In addition, caulk or other compound often spills over onto the guard 32 and it becomes messy and hard to use, especially if the compound hardens. This can shorten the useful life of the gun.

Figure 3:
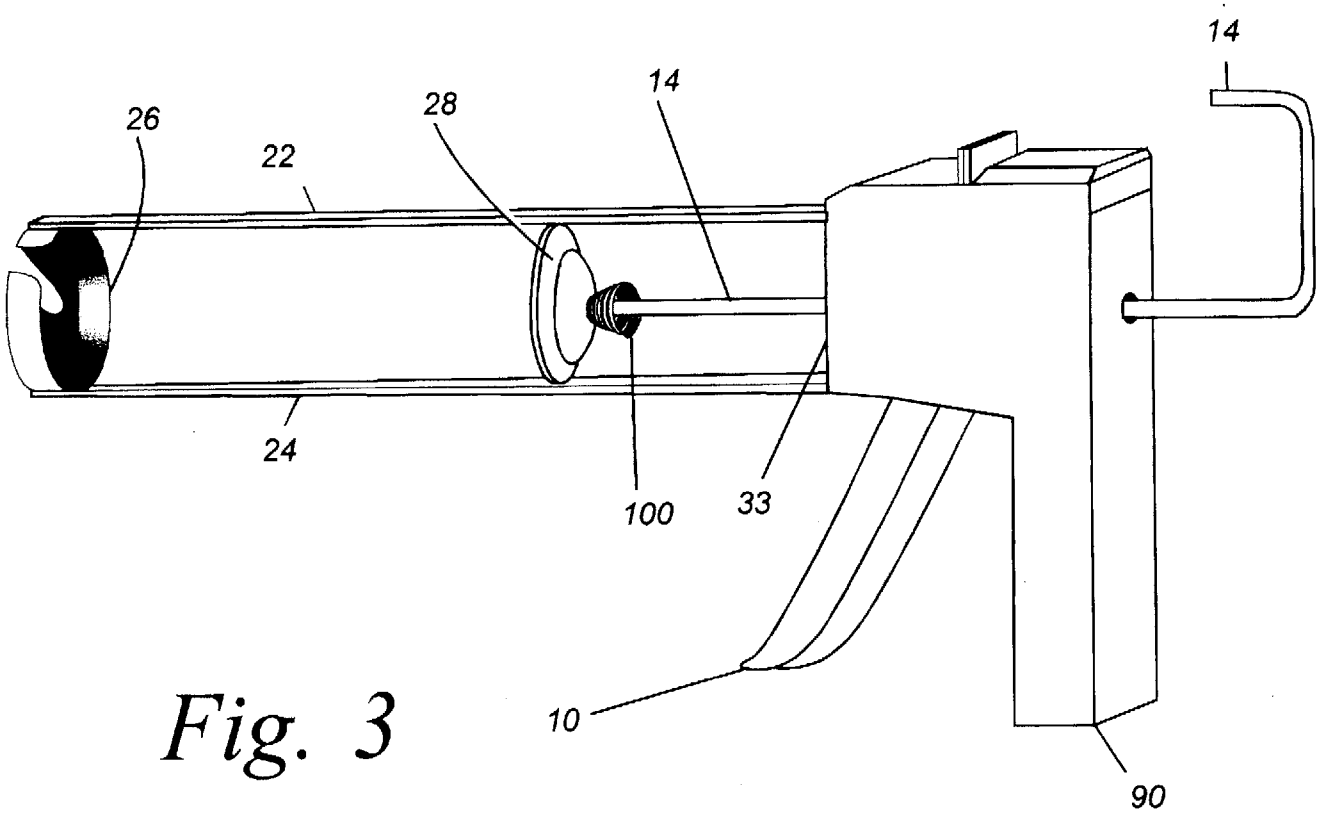
FIG. 3 is a side elevational view of one embodiment of the cartridge lock according to one embodiment of the present invention.

FIG. 3 is a side elevational view of one embodiment of a cartridge lock according to the present invention. The cartridge lock here comprises a constricted spring 100 that is preferably formed with progressively constricted coils from any suitable resilient material such as high carbon spring steel. Constricted spring 100 has one larger end formed with coils sized for free insertion over plunger shaft 14, and a constricted end formed with at least one tighter coil for gripping the plunger shaft 14. The constricted spring 100 is inserted onto the plunger shaft 14 and is carried thereon at any point between the piston 28 and supporting wall 33. Although constricted spring 100 is shown proximate the piston 28, it may also be positioned near or attached to supporting wall 33 as shown in FIG. 9.

The constricted spring 100 serves as a resilient spacer between the piston 28 and supporting wall 33. When the plunger shaft 14 is retracted for insertion/replacement of a cartridge, constricted spring 100 requires an additional measure of force for full retraction. This ensures that the piston 28 does not clear the confines of the cartridge until intended by the user. The user can feel when the piston 28 is about to clear the cartridge, and can consciously and carefully withdraw the piston 20 against the additional bias imparted by constricted spring 100. This serves as a simple, inexpensive and efficient cartridge locking mechanism for retaining the cartridge within the frame of the caulk gun until intentionally and fully released by the user. This helps to eliminate the potential safety hazard of inadvertent fall-through. The safety lock described above is automatic and easy to use by both right-handed or left-handed users.

It is noteworthy the cartridge-lock of the present invention compels the use of an open forward support yoke 26 for supporting the nozzle of the cartridge (e.g., one having an insertion slot for the cartridge nozzle as shown). Since the rear of the cartridge must be inserted into the frame first, a closed front support would block insertion.

Figure 4:
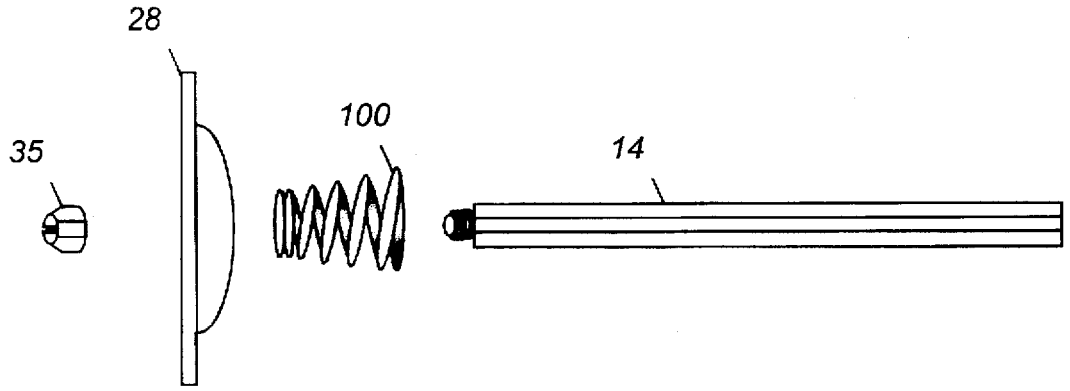
FIG. 4 is a side assembly drawing of the embodiment of FIG. 3.
Figure 5:
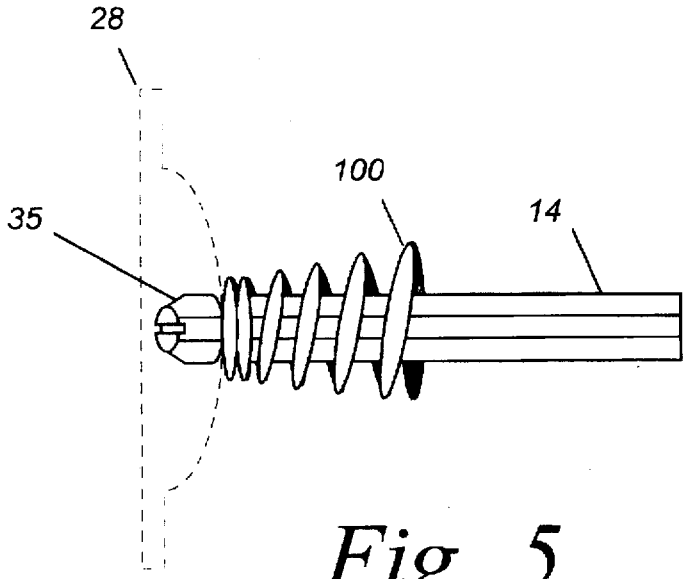
FIG. 5 is a side perspective view of the assembled cartridge lock of FIG. 3.

FIG. 4 is an enlarged side assembly drawing of the embodiment of FIG. 3. A threaded protrusion extends from the distal end of plunger shaft 14 to allow piston 28 to be secured thereto by means of a conventional nut 35 or other securing means. Piston 28 is inserted in advance of the nut 35. The larger coils of spring 100 are sized to fit freely over plunger shaft 14. At least one coil of spring 100 is constricted to a point where its outer diameter conforms to the plunger shaft 14 and frictionally grips shaft 14. The present invention is intended to encompass a spring 100 that is free to slide along plunger shaft 14 between piston 28 and supporting wall 33, and secured only by the friction of its constricted coil(s). However, it has been found that constricted spring 100 can serve the dual purpose of a lock washer for securing nut 35 onto the threaded protrusion of plunger shaft 14. This is accomplished by forming at least one coil of spring 100 so that it is constricted to a point where its outer diameter conforms to the threaded protrusion of plunger shaft 14. This way, as shown in the assembled drawing of FIG. 5, when the constricted coil(s) of spring 100 are seated on the threaded protrusion, they become sandwiched between the larger section of plunger rod 14 and piston 28. When nut 35 is tightened, the severed end of spring 100 bites the plunger rod 14 and acts as a lock washer.

Figure 6:
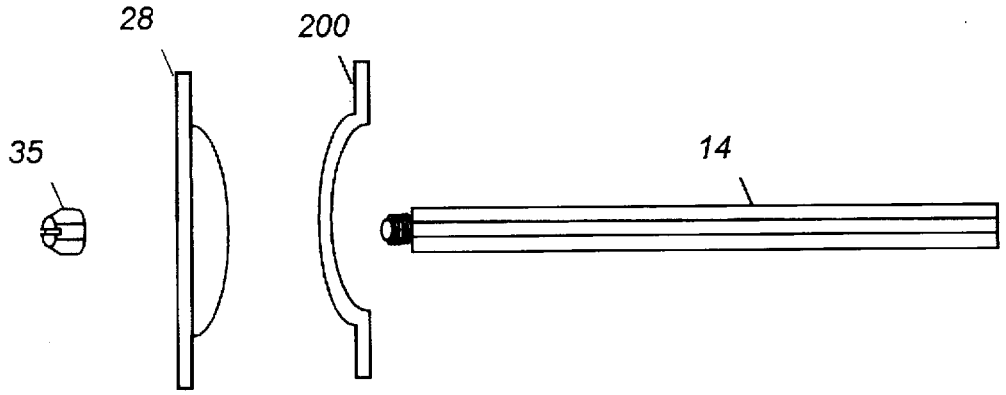
FIG. 6 is a side assembly drawing of another embodiment of the cartridge lock.

FIG. 6 is a side assembly drawing of another embodiment of the cartridge lock according to the present invention. The cartridge lock here comprises a section 200 of resilient material such as high-carbon spring steel that is preferably formed with an arc. Section 200 is further defined by a central through-bore sized for free insertion over plunger shaft 14.

Figure 7:
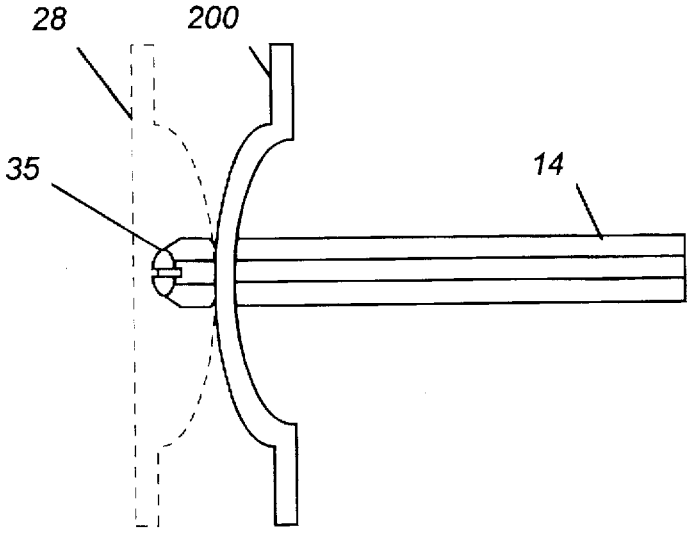
FIG. 7 is a side perspective view of the assembled cartridge lock of FIG. 6.

FIG. 7 is a side perspective view of the assembled cartridge lock of FIG. 6. The resilient section 200 is inserted onto the plunger shaft 14 and is carried thereon at any point between the piston 28 and supporting wall 33 as shown in FIG. 9, here arching backward toward supporting wall 33. Again, section 200 serves as a resilient spacer between the piston 28 and supporting wall 33, and although proximate the piston 28, it may also be positioned near or attached to supporting wall 33 as shown in FIG. 10. When the plunger shaft 14 is retracted for insertion/replacement of a cartridge, resilient section 200 becomes compressed between the piston 28 and supporting wall and requires an additional measure of force for full retraction. This ensures that the piston 28 does not clear the confines of the cartridge until intended by the user. The user can feel the additional bias when the piston 28 is about to clear the cartridge, and can consciously and carefully withdraw the piston 20 to overcome the additional bias imparted by resilient section 200. This likewise serves as a simple, inexpensive and efficient cartridge locking mechanism for retaining the cartridge within the frame of the caulk gun until intentionally and fully released by the user, thereby eliminating the potential safety hazard of inadvertent fall-through.

Figure 8:
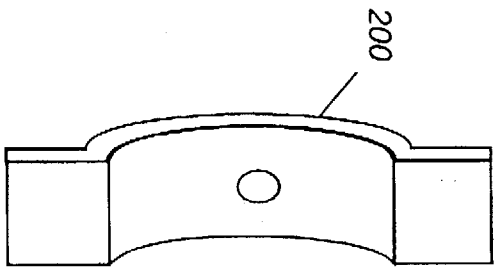
FIG. 8 is a side elevational view of the cartridge lock of FIGS. 6 and 7.

FIG. 8 is a side elevational view of the resilient section 200 of FIGS. 6 and 7. Resilient section 200 may be formed from a strip of resilient high-carbon spring steel that is bent to have an arcuate mid-section. Preferably, the ends of resilient section 200 are flared outwardly along a vertical plane to provide flat bearing surfaces against supporting wall 33. A central through bore is formed in the mid-section of resilient section 200 for insertion onto plunger shaft 14.

Again, it is intended that the resilient section 200 may be free to slide along plunger shaft 14 between piston 28 and supporting wall 33. However, resilient section 200 may serve the dual purpose of a washer in securing nut 35 onto the threaded protrusion of plunger shaft 14. This is accomplished by sizing the central through-bore to a point where its diameter conforms to the threaded protrusion of plunger shaft 14. This way, as shown in the assembled drawing of FIG. 7, when the resilient section 200 is seated on the threaded protrusion, it becomes sandwiched between the larger section of plunger rod 14 and piston 28. When nut 35 is tightened, the resilient section 200 acts as a washer.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

I claim:

1. An improvement for a dispensing gun having a frame extending forwardly of a supporting wall and adapted to receive a replaceable cartridge, and a piston distally mounted on a plunger shaft and drivable through said frame and cartridge for dispensing contents of the latter, the improvement comprising:

a constricted spring having one end formed with coils sized for insertion over said plunger shaft, and a constricted end formed with at least one tighter coil for frictionally gripping said plunger shaft, said constricted spring encircling said plunger shaft forwardly of said supporting wall;

whereby said constricted spring serves as a resilient spacer between said piston and said supporting wall and requires an additional measure of force for retraction of said plunger shaft in order to insert or remove a said replaceable cartridge.

2. The improvement for a dispensing gun according to claim 1, wherein said constricted spring is carried on said plunger shaft behind said piston.

3. The improvement for a dispensing gun according to claim 1, wherein said constricted spring is attached to said supporting wall and encircles said plunger shaft in advance thereof.

4. The improvement for a dispensing gun according to claim 1, wherein said at least one tighter coil of said constricted spring frictionally grips said plunger shaft, said spring frictionally riding said plunger shaft between said piston and supporting wall.

5. The improvement for a dispensing gun according to claim 1, wherein said plunger shaft includes a threaded protrusion extending from a distal end to allow said piston to be secured thereto by a nut, and said constricted spring includes at least one coil constricted to conform to said threaded protrusion, said constricted spring being inserted over said plunger shaft with said at least one coil seated around said threaded protrusion, whereby a severed end of said constricted spring bites the plunger shaft and acts as a lock washer when sandwiched by said piston.

6. An improvement for a dispensing gun having a frame extending forwardly of a supporting wall and adapted to receive a replaceable cartridge, and a piston distally mounted on a plunger shaft and drivable through said frame and cartridge for dispensing contents of the latter, the improvement comprising:

a resilient spacer having a central through-bore for slidable insertion over said plunger shaft, said through-bore being sized for frictionally gripping said plunger shaft, said spacer being carried by said plunger shaft between said piston and supporting wall;

whereby said resilient spacer is interposed between said piston and said supporting wall to require an additional measure of force for frictional retraction of said plunger shaft through the through-bore of said spacer in order to insert or remove a said replaceable cartridge.

7. The improvement for a dispensing gun according to claim 6, wherein said resilient spacer is carried on said plunger shaft behind said piston.

8. The improvement for a dispensing gun according to claim 6, wherein said resilient spacer is attached to said supporting wall.

9. The improvement for a dispensing gun according to claim 6, wherein said resilient spacer comprises a section of resilient material formed with an arc, and said central through-bore is centered in said arc.

10. The improvement for a dispensing gun according to claim 9, wherein said resilient spacer includes opposing ends flared outwardly from said arc along a common plane, said flared ends serving as flat bearing surfaces when compressed against said supporting wall.

* * * * *